US007814920B2

(12) United States Patent
Lenahan

(10) Patent No.: US 7,814,920 B2
(45) Date of Patent: Oct. 19, 2010

(54) CANOPY FOR A STATIONARY COVERING DEVICE HAVING AN ASYMMETRICAL SHAPE

(75) Inventor: David G. Lenahan, Walnut Creek, CA (US)

(73) Assignee: D'Firo Design, Inc., Lafayette, CA (US)

( * ) Notice: Subject to any disclaimer, the term of this patent is extended or adjusted under 35 U.S.C. 154(b) by 9 days.

(21) Appl. No.: 10/588,249

(22) PCT Filed: Feb. 6, 2004

(86) PCT No.: PCT/US2004/003331

§ 371 (c)(1),
(2), (4) Date: Aug. 2, 2006

(87) PCT Pub. No.: WO2005/084479

PCT Pub. Date: Sep. 15, 2005

(65) Prior Publication Data

US 2007/0130843 A1 Jun. 14, 2007

(51) Int. Cl.
*A45B 17/00* (2006.01)
*A45B 25/00* (2006.01)

(52) U.S. Cl. ..... 135/20.1; 135/21; 135/31

(58) Field of Classification Search ..... 135/20.1, 135/31, 33.71
See application file for complete search history.

(56) References Cited

U.S. PATENT DOCUMENTS

| | | | | |
|---|---|---|---|---|
| 553,735 | A | 1/1896 | Murgatroyd | |
| 2,671,459 | A * | 3/1954 | Henderson | 135/20.1 |
| 2,707,476 | A | 5/1955 | Clemens | |
| 2,841,160 | A * | 7/1958 | Dewispelere | 135/33.71 |
| 2,948,289 | A | 8/1960 | Owczarek | |
| 1,053,337 | A | 2/1962 | Williams | |
| 3,042,055 | A | 7/1962 | Todorovic | |
| 4,474,201 | A | 10/1984 | Kida | |
| 4,597,400 | A | 7/1986 | Trudeau, Sr. | |
| 4,838,290 | A | 6/1989 | Wu | |
| 5,086,797 | A * | 2/1992 | Earnshaw et al. | 135/20.1 |
| 5,505,221 | A | 4/1996 | Gao | |

(Continued)

FOREIGN PATENT DOCUMENTS

| | | |
|---|---|---|
| DE | 34 36 080 A1 | 4/1968 |

(Continued)

*Primary Examiner*—David Dunn
*Assistant Examiner*—Danielle Jackson
(74) *Attorney, Agent, or Firm*—David E. Heisey; Sheppard Mullin Richter & Hampton LLP

(57) ABSTRACT

A canopy for a stationary covering device in accordance with the present invention comprises a cover that has a vertex point. The vertex point can be characterized by a fixed uppermost point or tip, at the highest culminating point of the canopy from which the cover projects. According to the invention, the cover includes unequal extensions from the vertex point. As such, the vertex point comprises an asymmetrically positioned vertex point. More specifically, the canopy of the invention is rotatable around a fixed longitudinal axis that is elevated from the ground. In this way, the canopy provides an adjustable coverage zone for a pre-determined stationary area beneath it when it is either rotated or tilted, and located at a suitable elevated level relative to the ground, from a first canopy position to a second canopy position.

20 Claims, 8 Drawing Sheets

U.S. PATENT DOCUMENTS

| | | | | |
|---|---|---|---|---|
| 5,564,453 | A | 10/1996 | Steinger | |
| D419,759 | S | 2/2000 | Goudarzi | |
| 6,422,252 | B1 | 7/2002 | Pilz | |
| 2002/0129847 | A1* | 9/2002 | Ma | 135/98 |
| 2004/0134526 | A1* | 7/2004 | Freedman | 135/20.3 |

FOREIGN PATENT DOCUMENTS

| | | |
|---|---|---|
| WO | WO 99/44458 | 9/1999 |

* cited by examiner

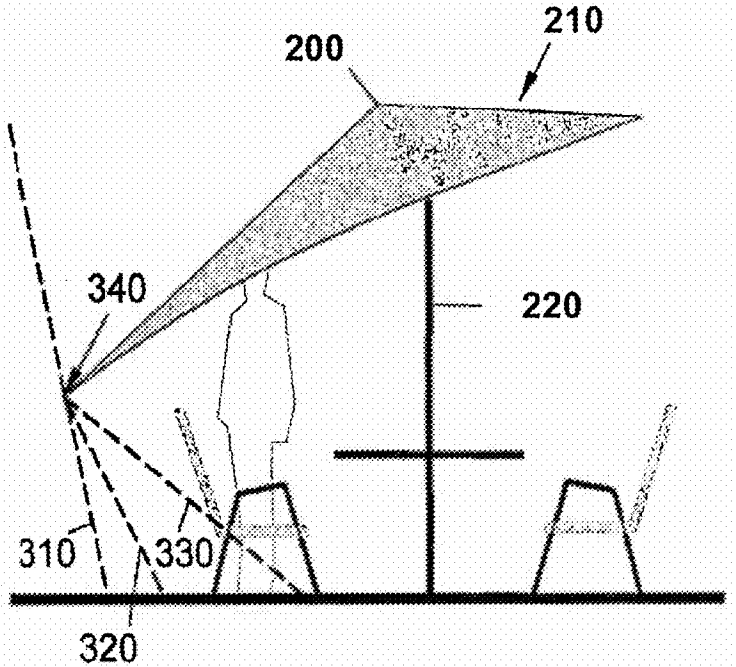
FIG. 3(B)
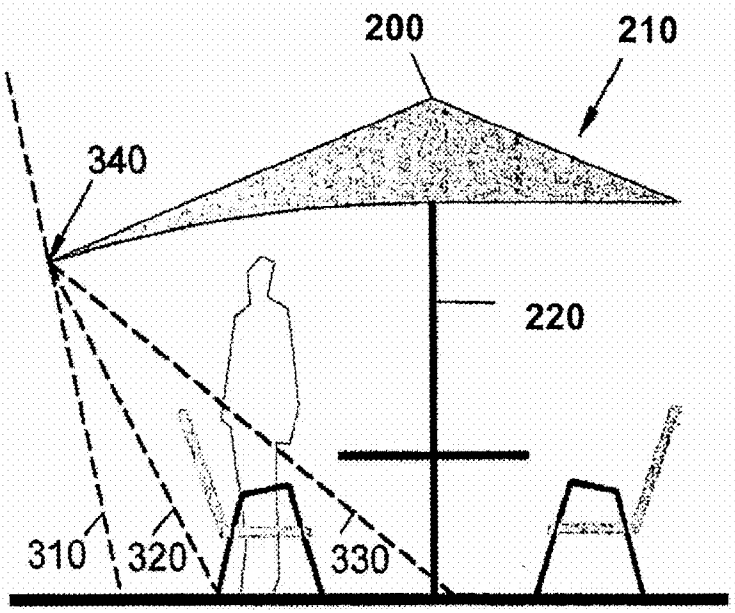
FIG. 3(A)
FIGURE 3

CANOPY FOR A STATIONARY COVERING DEVICE HAVING AN ASYMMETRICAL SHAPE

FIELD OF INVENTION

The field of this invention concerns stationary covering devices and canopies for outdoor protection. More particularly, the present invention relates to a covering device and canopy that provides protection using an asymmetrically shaped cover.

BACKGROUND OF THE INVENTION

Covering devices that provide either stationary protection nixed in relation to the ground) or portable protection (i.e., mobile in relation to the ground) for shading, rain, dust, etc. are known. Examples of stationary or fixed covering devices, which are substantially larger than the mobile and portable covering devices, include fixed shading devices, umbrellas, and/or parasols used as an accessory to outdoor furniture. Examples of mobile covering devices include portable umbrellas, visors, etc.

The present invention relates to stationary covering devices that because of their larger size are subject to different functional requirements when compared to mobile and portable covering devices. Typically, prior art stationary covering devices have canopies with symmetrically shaped covers that can rotate about a longitudinal axis that provide symmetrical and equidistant cover extensions from a central vertex point. Exemplary conventional canopies have round, square, or polygonal symmetrical shapes. Such covering devices that embody the aesthetics of symmetry, fail to provide the function of a covering and shading device, namely, convenient and effective security and protection (e.g., from the sun) for the persons and things beneath the covering device. The inventor of the present invention has recognized that the symmetrical shape of the conventional canopies does not provide consistent shading throughout the year, particularly during the hottest months when people tend to spend the most time outdoors, and when the most direct solar radiation and related ultra violet levels are at their highest. Furthermore, the symmetrical shape of the conventional canopies does not provide consistent protection in lower latitudes (e.g. tropical and subtropical locales), where people tend to spend more time outdoors both on a daily, and subsequently, an annual basis, and where the solar radiation and related UV levels are stronger, as compared to higher latitudes, throughout the year. As explained later in detail, the lack of effective shading is especially apparent when viewed with the inconveniences of relocating shading targets or moving large-size stationary covering devices in order to enjoy consistent shading at a fixed location. For example, people sitting around a outdoor table that is shaded by a prior art symmetrically shaped canopy have to be moved to within the moving, small shaded area, consequently, leaving a few people without effective shading, at least in part, and/or exposing food or items to harmful sun exposure.

Some conventional covering devices use a tilt function in an attempt to correspondingly position the canopy relative to position of the sun. However, even with the symmetrical canopy in a tilted position, the shading targets underneath the covering device would still need frequent change of position in order to avoid sun's damaging rays throughout the day. This movement is required mainly because the position of the sun relative to shading targets constantly changes, and the fact that a symmetrical device is not designed to intercept the predictable angles of solar incidence.

In one mobile or portable application, U.S. Pat. No. 4,597,400 to Trudeau discloses a portable umbrella that looks like a baseball hat when extended. The brim of the baseball cap umbrella is present merely to create a resemblance to a baseball cap. U.S. Pat. No. 4,838,290 to Wu modifies the Trudeau patent to allow the user of portable umbrella to have a clear line of vision under a flat brim. However, there is no teaching or suggestion in Trudeau or Wu regarding the application of the disclosed concept to either fixed or stationary covering devices. In fact, the disclosed umbrella designs are intended for mobile and portable applications in which a user carries the umbrella with them, on their person. Therefore, neither the Trudeau nor the Wu designs are intended to service a stationary location. Furthermore, these designs do not take into account the solar angles related to the changing position of be sun throughout daylight hours.

U.S. Pat. No. 5,564,453 to Steiner discloses a umbrella having a symmetrically shaped canopy that is adjustable and/or extendible. The adjustable canopy allows for placement of the umbrella against a wall, for example, and can be adjusted to various sizes. It does not, however, account for any solar angles. Therefore, even though the canopy can be adjusted, there will still be areas underneath the apparatus that will not be shaded depending on the location of the sun and the time of the day.

U.S. Design Pat. No. 419,759 to Goudarzi discloses a non-stationary, handheld, octagonal, ornamental design for a rain umbrella. Once again, this ornamental design is primarily aesthetic and fails to consider predictable solar angles.

U.S. Pat. No. 5,505,221 to Gao discloses a non-stationary handheld umbrella with an asymmetrical, off-center support. The asymmetry and projecting visor edge create a protection zone when the umbrella is carried by the user, such that, instead of the umbrella shaft, the head and shoulders of the user would be directly under the center of the covering device. Because of its portable (non-stationary) design, however, the canopy of this umbrella design is not shaped to take into account the position of the sun or for creating a shading zone in a fixed location.

FIG. 1 shows a conventional stationary covering device that provides shading for shading targets at a particular time of day and year at a particular locale and latitude. In this case, the solar angles shown in FIG. 1 are those occurring on June 21, at 2 o'clock p.m. The covering device has a canopy 110 that is symmetrical about a support pole 120 in the center of a table 130 surrounded by shading targets defined by four chairs 140, 150, 160 and 170. As shown, in one furniture arrangement, two chairs 140 and 150 are positioned in direct sunlight and two other chairs 160 and 170 are in a shaded zone 180. In order for all four chairs 140, 150, 160 and 170 to be in the shaded zone 180 they would have to be either placed extremely close to one another or partially away from the table. Therefore, the use of symmetrically shaped canopies according to the prior art either exposes one or more people seating on the chairs to the harmful rays of the sun or causes overcrowding that would subject the people to uncomfortable seating arrangement within the shaded zone 180. Furthermore, a portion of the table 130 is also exposed to direct sunlight which would cause food, beverages, and other items to overheat, melt, or even spoil due to direct exposure to the sun. At certain times of the day, such as early morning or late afternoon, all four chairs would need to be located completely away from the fixed location table in order for them to be within the shaded zone. The fixed shading target zone 100 is not protected during the day.

The Environmental Protection. Agency, the World Health Organization, and other governmental and advisory agencies advise that over-exposure to ultraviolet radiation from the sun will lead to serious health risks, including skin cancer, premature aging of the skin and eye damage.

The best way to prevent these serious health risks, without staying indoors at all times, is to limit exposure to direct sunlight and to seek cover so as not to be directly exposed to the sun when spending time outdoors. The limitations presented by the prior art symmetrical covering devices do not provide effective shading at a fixed location without the inconvenience associated with either frequently moving shading targets (people, chair, etc.) or the shading device throughout the day.

Thus, there has been a long felt need in the art to solve the problem of creating an economical, stationary covering device of adequate size that will provide maximum and consistent protection or shading with minimum movement. None of the prior art devices adequately have solved this problem, either alone, or in combination with one another. In short, there exists a need for a stationary, convenient and simple approach to stationary covering devices that does not suffer from the aforementioned drawbacks of the prior art in terms of convenience, complexity, excess movements, labor, cost, etc.

SUMMARY OF INVENTION

Briefly, according to the present invention, a canopy for a stationary covering device comprises a cover that has a vertex point. The vertex paint can be characterized by a fixed uppermost point, or tip, at the highest culminating point of the canopy from which the cover extends. According to the invention, the cover includes unequal extensions from vertex point. As such, the vertex point comprises an asymmetrically positioned vertex point. More specifically, the canopy of the invention is rotatable around a fixed longitudinal axis relative to the ground. In this way, the canopy provides a consistent coverage zone within a targeted stationary area when it is rotated, at a suitable elevated level relative to the ground, from a first canopy position to a second canopy position.

In a primary application, the canopy provides shading, when elevated. Therefore, the coverage zone comprises a shaded zone for providing shading during daylight hours. However, the cover, as defined herein, includes any device that affords protection or security to various objects, rays, and particles that are present outdoors. Consequently, the canopy of the present invention, for example, can also provide protection from light, harmful rays (e.g., sun, ultraviolet, etc.), rain, dust, etc.

According to some of the more detailed features of the present invention, the cover can be made of any suitable, preferably lightweight, material. The cover can be made of pliable material supple enough to bend freely or repeatedly without breaking, such as cloth, nylon, etc. The cloth itself can be made of any suitable material, for example, woven, kited, or knitted, natural or synthetic fibers and filaments. In an exemplary embodiment, the pliable material comprises lightweight ultraviolet resistant material. In another, the pliable material yields adjustably to varying weather conditions and/or conditions of device use.

According to other more detailed features of the invention, the cover can be fabricated as a single integrated unit that functions as a cover, for example, using cloth, molded pieces, plastic, etc. Alternatively, the cover can be made up of sub-units, e.g., cloth, molded pieces, plastic, etc., that are pieced together to provide the cover and shading function to the canopy of the invention.

The cover can further include traversal support members that support the unequal extensions of the cover from the vertex point 200 in FIG. 2. For example, the traversal support members can comprise support ribs that traverse the cover creating a vaulted space for the cover. The support ribs can cross the cover a way that the vaulted space of the cover is divided into substantially triangular segments. Under this arrangement the unequal extensions define or otherwise relate to a ratio of asymmetry relative to the highest culminating point of the canopy. In the preferred embodiment, the ratio of asymmetry is between a range of 1.5:1 and 2.3:1. This ratio is a ratio between the length of the exemplary octagonal extension 410 to the length of the visor extension 415 as shown in FIG. 4, as measured out from the apex point 200 in the plan view. As described later in more detail, the support member can have fixed or variable length.

The traversal support members can have fixed or variable length. Also, the traversal support members can be collapsible members, retractable members, extendible members or otherwise telescopic members.

According to another aspect of the invention, a covering device according to the present invention, comprises the above-described canopy and a fixed support mechanism for positioning the canopy at an elevated level relative to the ground. In this way, the targeted coverage zone is created when the canopy is rotated from the first canopy position to the second canopy position at the elevated level that corresponds to the height of the vertical support 220 in FIG. 2.

In one embodiment of this aspect of the invention, the fixed support mechanism comprises a vertical support located both at the asymmetrically positioned canopy vertex point and from below the canopy cover. For example, the support mechanism under this embodiment can be any long and slender object with a suitable shape, e.g., cylindrical, and a fixed longitudinal axis that is perpendicular to the ground. Examples of such support mechanism can be shafts, rods, pipes, tubes, or poles that are fixedly positioned in an upright or otherwise perpendicular (i.e., vertical) position relative to the ground.

According to another embodiment of this aspect of the invention, the canopy of the covering device is fastened to some elevated support 815 in FIG. 8 without support from below the canopy. For example, the fixed support mechanism can be a cantilevered support 810 in FIG. 8 at the asymmetrically positioned canopy vertex point 800 in FIG. 8 and having a projection upward from above the canopy. In this way, an adjustable, targeted coverage zone is created when the canopy is rotated from the first canopy position to the second canopy position at the elevated level that corresponds to the height of the cantilevered support 810 in FIG. 8.

The cantilevered support can include a projecting beam or member that is supported at only one end, for example, a bracket-shaped member that supports the canopy 820 in FIG. 8. In this way, the canopy is free on all sides except at the point of support at the asymmetrically positioned vertex point 800 in FIG. 8. Therefore, the covering device of the invention according to this embodiment has a suspended canopy arrangement, whereby the cover of the canopy can be adjustably positioned at any point throughout a three hundred and sixty degree arc.

Other features and advantages of the present invention will become apparent from the following description of the preferred embodiments, taken in conjunction with the accompanying drawings, which illustrate, by way of example, the principles of the invention.

BRIEF DESCRIPTION OF THE DRAWINGS

FIGS. 3 (A) and (B) show side elevation views of the stationary covering device of FIG. 2, providing coverage to the shading target zone below the canopy, at predictable solar altitude angles for twelve o'clock p.m. (Noon), two o'clock p.m., and four o'clock p.m, on June 21, at 34 degrees North latitude.

DETAILED DESCRIPTION OF PREFERRED EMBODIMENTS

Figure 1:
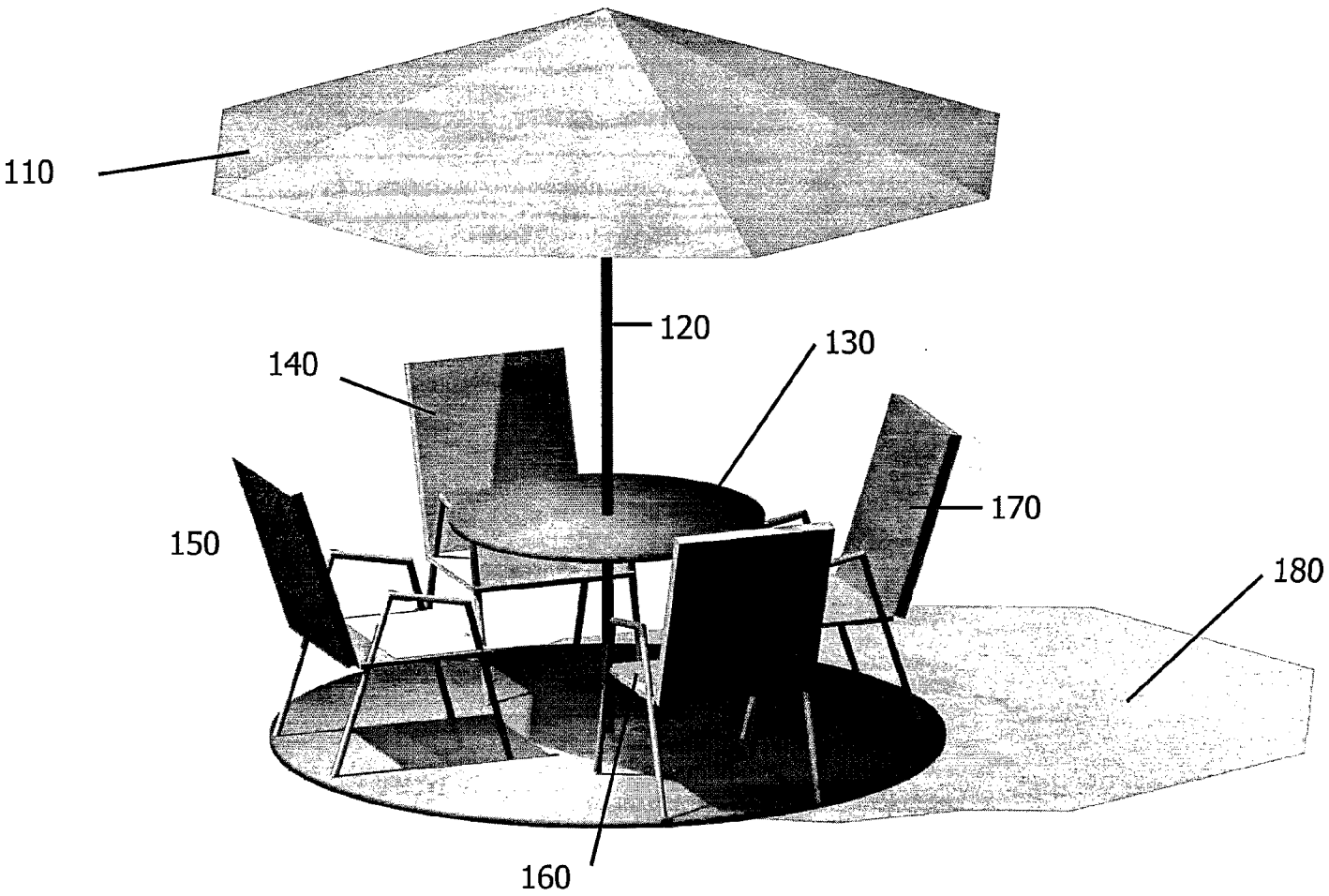
FIGURE 1 Prior Art
FIG. 1 shows a perspective view of a prior art covering device that provides a conventional zone of shade that moves both toward and away from, the fixed target area during the day. The zone of shade shown occurs on June 21 at 2 o'clock pm, at 34 degrees North latitude.

In the following description, numerous specific details are set forth in order to provide a thorough understanding of the invention. One skilled in the art would recognize, however, that the invention might be practiced without some or all of these specific details. In other instances, well known methods, procedures, and/or components have not been described in detail so as to not unnecessarily obscure the novel aspects of this invention.

The canopy for a stationary covering device in accordance with the present invention is intended to overcome the aforementioned shortcomings through a novel and original canopy design that provides convenient, effective and consistent outdoor protection to a fixed target area throughout the day. Briefly, the present invention provides such protection by a novel and unique approach that modifies the symmetrical shape of the conventional canopy to an asymmetrical shape in a stationary covering device. The canopy shape, according to the present invention, is designed to take into account the solar angles encountered during daylight hours, and the amount of coverage area required to comfortably protect shading targets at a fixed location, such as typical outdoor table and chair arrangements in a stationary setting.

The "Canopy"

The canopy for a stationary covering or shading device in accordance with the present invention comprises a cover that has a vertex point that is characterized by a fixed uppermost point, or tip, at the highest culminating point of the canopy from which the canopy extends. According to the invention, the canopy includes unequal extensions from the vertex point, which is an asymmetrically positioned vertex point around which the canopy of the invention is rotatable. A fixed longitudinal axis defines the elevation height both for mounting and for rotating the canopy. In this way, the canopy provides a consistent coverage zone thr a desired stationary area when it is rotated from a first canopy position to a second canopy position. In one exemplary embodiment, the canopy can be used to create a fixed location shading zone at various times of the day based on the predictable angles of the sun as it changes position.

The "Cover"

The cover can be any device that provides outdoor protection, including protection from light, harmful rays (e.g., sun, ultraviolet, etc.), rain, dust, etc. The cover can also be made of various suitable material, including pliable material supple enough to bend freely or repeatedly without breaking, such as cloth, plastic, nylon, etc. For example, the cloth can be, woven, felted, or knitted, natural or synthetic fibers and filaments. Such natural or synthetic fibers and filaments can be made of lightweight ultraviolet resistant material and/or material that yields adjustably to varying weather conditions and/or conditions of device use. The cover can be a single integrated unit or it can be made up sub-units, cloth, molded pieces, etc., that are pieced together to provide the protection function of the cover.

Figure 4:
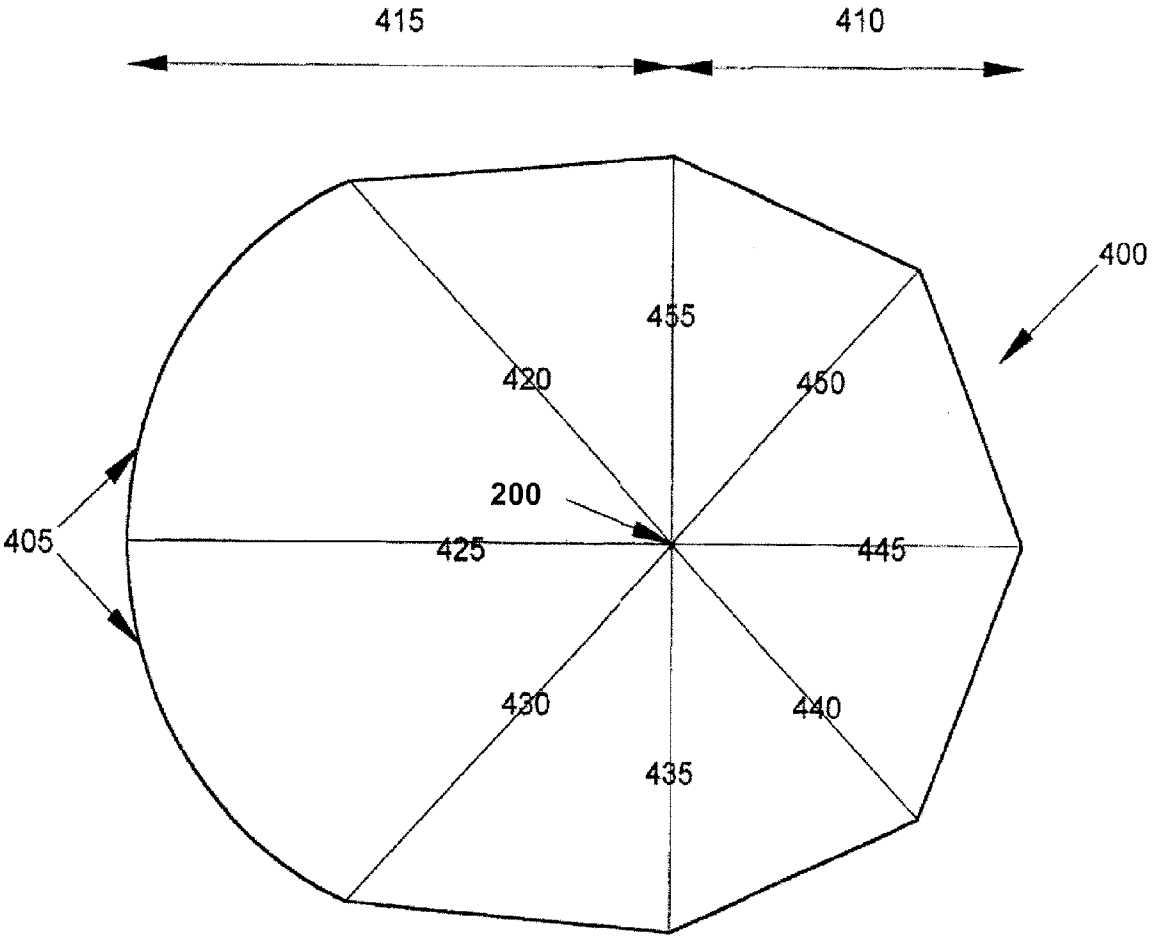
FIG. 4 shows a plan view of a cover for the canopy of the covering device in accordance with the present invention.

The cover can further include support members that support the unequal extensions from the vertex point. Under this arrangement the unequal extensions define a ratio of asymmetry relative to the highest culminating point or vertex of the canopy. In the preferred embodiment, the ratio of symmetry is between a range of 1.5:1 and 2.3:1. This ratio is a ratio between the length of the exemplary octagonal extension 410 to the length of the visor extension 415 as shown in FIG. 4, as measured out from the apex point 200 in the plan view. The support member can have either fixed or variable length. The support member can be a collapsible member, a retractable member, an extendible member or otherwise telescopic member. For example, the support member can comprise support ribs that traverse the cover creating a vaulted spacing. The traversal support members meet and cross one another, thereby dividing the vaulted space of the cover into segments that are basically triangular in shape.

The "Covering Device"

According to another aspect, the covering device according to the present invention comprises the above-described canopy and a fixed support mechanism for positioning the canopy at an elevated level relative to the ground. In one embodiment, the fixed support mechanism comprises a vertical support originating at the asymmetrically positioned canopy vertex point from below the canopy. For example, the support mechanism under this embodiment, can be any long and slender object, for example, a cylindrical or other suitably shaped object, with a longitudinal vertical axis that is perpendicular to the ground. Examples of such support mechanisms can be shafts, rods, poles, tubes, or pipes that are fixedly positioned upright or otherwise perpendicular (i.e., vertical) relative to the ground.

In another embodiment, the canopy vertex is fastened to some elevated point without support from below the canopy and is free on all sides except at the point of support at the asymmetrically positioned canopy vertex point. As such, the fixed support mechanism comprises a cantilevered support terminating directly above the asymmetrically positioned canopy vertex point, and a vertical projection from the termination of the cantilevered support to the canopy vertex point. The fixed support mechanism is shaped to allow the canopy to be adjusted anywhere throughout a horizontal arc of rotation. The cantilevered support includes a projecting beam or member that is supported at only one end, for example with a bracket-shaped member that supports the canopy. In this way, the canopy is free on all sides except at a point of support from the above the asymmetrically positioned canopy vertex point.

Figure 2:
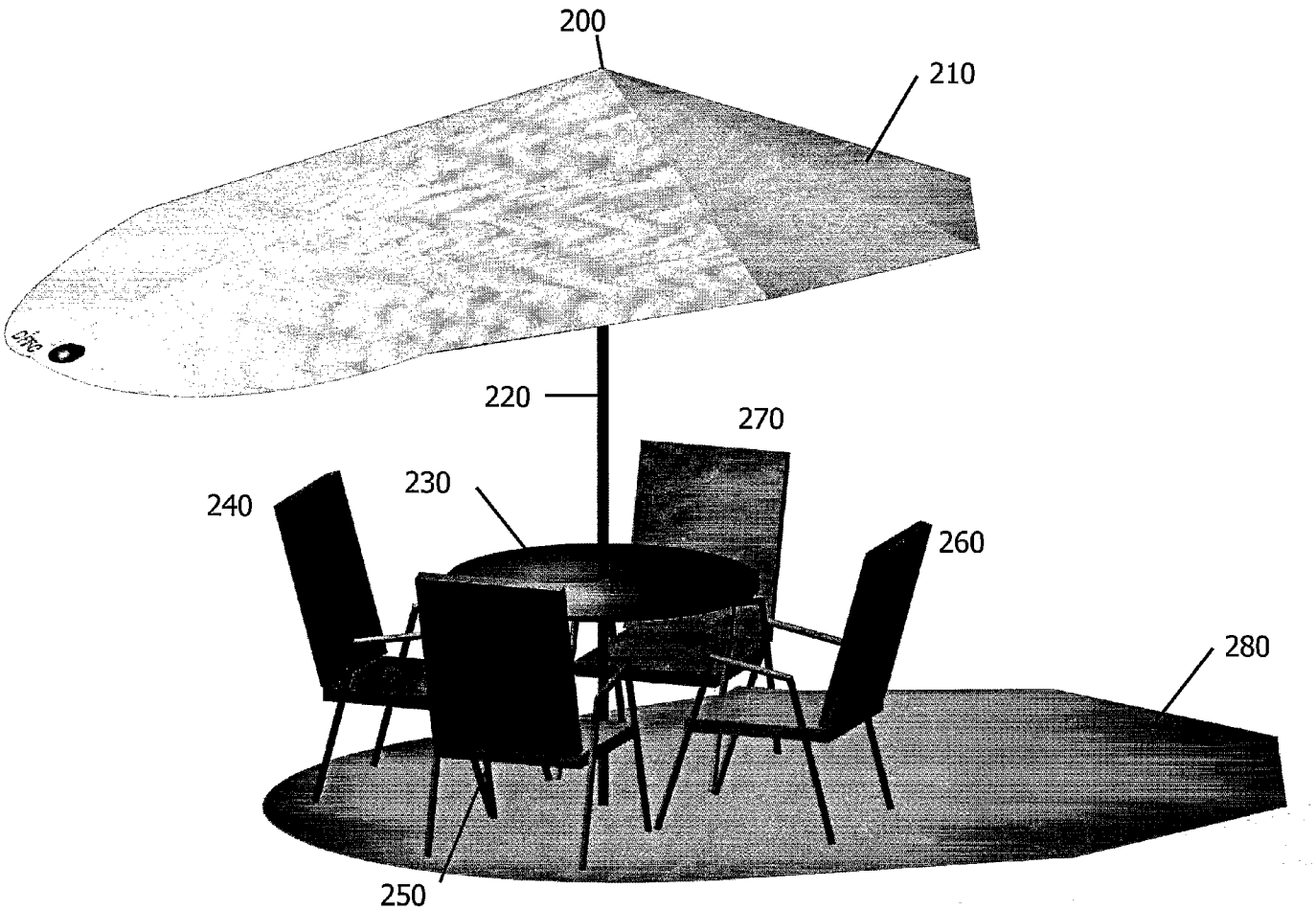
FIG. 2 shows a perspective view of a stationary covering device in accordance with one aspect of the present invention that provides a consistent coverage zone for the fixed shading target area.

FIG. 2 shows a perspective view of one exemplary embodiment of the covering device in accordance with one aspect of the invention having a canopy 210 and a fixed support mechanism 220. In the exemplary embodiment shown in FIG. 2, the fixed support mechanism 220 is a long and slender object with a longitudinal axis that is perpendicular to the ground. As described later in detail, a portion of the fixed support mechanism 220 may be tilted relative to the longitudinal axis, for example, via a hinge, to extend the range of coverage to the targeted shading zone during daylight hours. As can be seen, the fixed support-mechanism 220—under this arrangement is a vertical support affixed at an asymmetrically positioned vertex point 200 from below the canopy. As such, the canopy 210 is not symmetrical and the support pole 220 is not situated in its geometric center, unlike the prior art symmetrically shaped canopies. Rather, the pole 220 is located asymmetrically. The canopy 210 has a cover that, when elevated, provides outdoor protection for the covering device of the invention. The cover has a vertex point 200 characterized by a fixed uppermost point, or tip, at the highest culminating point of the canopy 210 from which the canopy 210 extends. The cover includes unequal extensions from the vertex point 200, which is an asymmetrically positioned vertex point around which the canopy 210 of the invention is rotatable.

As shown, at a particular time of day and year at a particular latitude, for example. June 21, 22 o'clock p.m., at 34 degrees North latitude, all four targets depicted in FIG. 2 as seating locations 240, 250, 260, and 270 are located within a targeted coverage zone 280. The table 230 is also completely in the coverage zone 280 allowing for food or beverages to be placed there without being exposed to the sun and spoiling and either melting or spoiling.

FIGS. 3 (A) and 3 (B) depict how the canopy of the stationary covering device intercepts direct sunlight during the day. The present invention takes into account the incidence of the sun's rays based on the altitude and azimuth angles of the sun, both known variables. Solar angle and solar position data is widely available, for example, from the Astronomical Applications Department at the United States Naval Observatory in Washington, D.C. The canopy, 210, therefore, intercepts the rays of the sun throughout the day and provides shading to the targeted coverage zone directly beneath it as long as the proper edge 340 of the canopy 210 is oriented toward the direct rays of the sun. Although FIG. 3A and FIG. 3B show only the solar altitude angles at twelve o'clock p.m. 310, two o'clock p.m. 320, and four o'clock p.m. 330, both the solar altitude and the solar azimuth angles are available for every hour between sunrise and sunset for any longitude and latitude point on the face of the Earth. It should be noted that in terms of solar altitude angles. 10 o'clock a.m. corresponds to 2 o'clock p.m. and 8 o'clock a.m. corresponds to 4 o'clock p.m. However, the solar azimuth angles differ for these time comparisons.

Throughout the day, but particularly in the early morning or late afternoon when the solar altitude angles are at their lowest angle of incidence, the canopy 210 can be tilted, as described further in detail below, in anticipation of the predictable altitude angles of the sun during those hours. The tilting function further extends the daily range of consistent coverage to the target zone. Therefore, the canopy provides consistent outdoor protection of the targeted coverage zone conveniently at all times by positioning, moving or otherwise rotating the canopy at a desired elevated point at the asymmetrical vertex point 200 along a straight longitudinal axis of the fixed supporting mechanism 220, or a tilted longitudinal axis as decried further in detail. As a result, the only movement equipped is a slight turn or positioning about the fixed supporting mechanism 220 so that the canopy leading edge 340 is directly facing the sun's rays. Unlike the prior art symmetrical shading arrangements, under the present invention no movement of coverage targets (e.g., chairs, tables, lounges, or persons) is required in order to maintain a consistent coverage zone about a fixed to target area of coverage.

In FIG. 3A, predictable solar altitude angles are shown at twelve o'clock p.m. 310, two o'clock p.m. 320, and four o'clock p.m. 330. In both FIG. 3A and FIG. 3B, the solar azimuth angles have been superimposed, and demonstrate the result of positioning the leading edge 340 of the visor portion of the canopy 210 directly toward the sun at those times.

The leading edge 340 of the visor portion of the canopy 210 can be pointed towards the sun's direct rays by turning the supporting mechanism 220 to which the canopy is fastened. As a result, and as illustrated in FIG. 3A, the table is not exposed to the sun at either twelve o'clock p.m. 310, two o'clock p.m. 320, or at four o'clock p.m. 330.

As shown in FIG. 3B, the targeted coverage zone at twelve o'clock p.m. 310, two o'clock p.m. 320, and four o'clock p.m. 330 can be increased in the early morning or late afternoon hours, best represented by the 4 o'clock angle 330, by tilting the canopy 210 in a downwardly direction. As previously noted, not all of the daily solar angles are shown in FIG. 3(A) or 3 (B). However, according to the described principle of the invention, the canopy can provide outdoor protection from the sun at any solar altitude angle. Proper dimensioning of the canopy, including the asymmetry ratio of the canopy can be used to accommodate a wide variety of shading applications. Under this arrangement, the unequal extensions of the cover and the canopy define a ratio of asymmetry relative to the highest culminating point or vertex of the canopy 200 in FIG. 4, and between the unequal extensions of lines 425 and 445 in FIG. 4. In the preferred embodiment, this ratio of asymmetry is between a range of 1.5:1 and 2.3:1. This ratio is a ratio between the length of the exemplary octagonal extension 410 to be length of the visor extension 415 as shown in FIG. 4, as measured out from the apex point 200 in the plan view.

FIG. 4 shows a plan view of an exemplary cover 400 for the canopy of the present invention. In this exemplary embodiment, the cover 400 is not symmetrical. The cover 400 has a tip or apex at the asymmetrically positioned vertex point 200 relative to which the canopy can be elevated to create the coverage zone. The cover 400 has two distinct, unequal extensions 410 and 415. The two unequal extensions 410 and 415 consist of an exemplary octagonal extension 410 and a visor extension 415, although the extensions may comprise any suitable shape, arrangement, or plurality of segments. The exemplary octagonal extension 410 is one whereby the shape resembles that of a half-octagon with four of the eight outside edges normally found in a complete, geometrical octagon. In an exemplary embodiment, the visor extension 415 has a curved leading edge 405.

In another exemplary embodiment, the cover 400 includes support members that support the unequal extensions from the vertex point 200. The support member can be a collapsible member, a retractable member, an extendible member or otherwise telescopic member. For example, the support member can comprise support ribs that traverse the cover 400 creating a vaulted spacing. The traversal support members meeting and crossing one to another, thereby divide the vaulted space of the cover into substantially triangular segments, as shown. As stated above, the cover 400 can be a single integrated unit or it can be made up sub-units, e.g., cloth, molded pieces, etc., that are pieced together to provide the protection function of the cover.

In an exemplary embodiment of the invention, the plan width of the cover 400 measured along ribs 435 and 455 is 8' and 11.5" and the plan length of the canopy 400 measured along the long primary horizontal axis, depicted by ribs 425 and 445, is 11' and 5.5". The plan length of the octagonal extension 410 segments 435 through 455, inclusive, is 4' and 5.75". The plan length of the visor extension main rib 425 is 6' and 11.75". This is but one example, and the exemplary octagonal extension 410 and visor extension 415 may be any number of different lengths and widths, whether of directly proportional dimensions or not. As such, the unequal extensions 410 and 415 of the cover 400 define a ratio of asymmetry relative to the highest culminating point 200 of the canopy. In the preferred embodiment, the ratio of asymmetry is between a range of 1.5:1 and 2.3:1. This ratio is a ratio-between the length of the exemplary octagonal extension 410 to the length of the visor extension 415 as shown in FIG. 4, as measured out from the apex point 200 in the plan view. As described later in more detail, the support member can have fixed or variable length.

Figure 5:
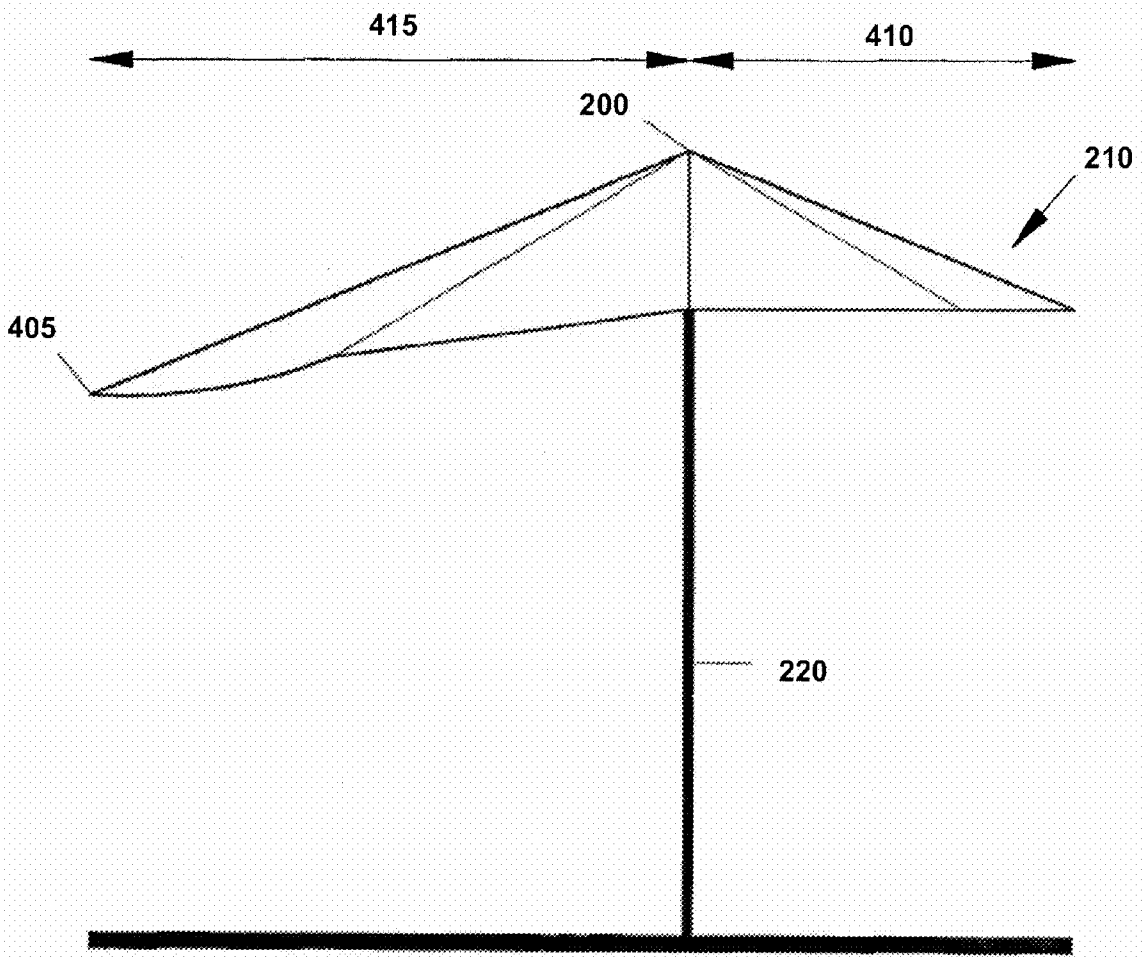
FIG. 5 shows a side elevation view of the canopy of the present invention as it can be rotated around a vertical longitudinal axis.

FIG. 5 shows an side elevation view of a stationary covering device 210 having a fixed vertical support mechanism 220 from below the canopy. The fixed vertical support mechanism 220, shown as a pole, fastens at or directly below, the asymmetrical vertex point 200 of the canopy between two unequal extensions of the cover, i.e., the exemplary octagonal extension 410 and the visor extension 415. A curved leading edge 405 is part of the visor extension 415 and is intended to point directly towards the sun's direct rays at all times so that the coverage zone will protect the fixed targets located directly underneath the canopy. Once fastened to the canopy, the fixed vertical support mechanism 220 only needs to be turned or otherwise rotated from a first canopy position to a second canopy position so that the curved leading edge 405 points towards the sun, thereby adjustably creating the maximum and consistent coverage zone for the fixed shading targets at any given time of day and year for any given locale and latitude.

In a preferred embodiment of the invention, the height of the octagonal extension 410 of the canopy of the stationary covering device 210 measured vertically from the lower edge of the canopy exemplary octagonal extension 410 to the asymmetrical canopy vertex point 200 is 1' and 8" high. The height of the visor extension 415 treasured vertically from the lowest point of the curved leading edge 405 to the asymmetrical vertex point 200 is 2' and 7.125". This is but one example, and the exemplary canopy and cover may be any number of different extension heights, whether of directly proportional dimensions or not.

Figure 6:
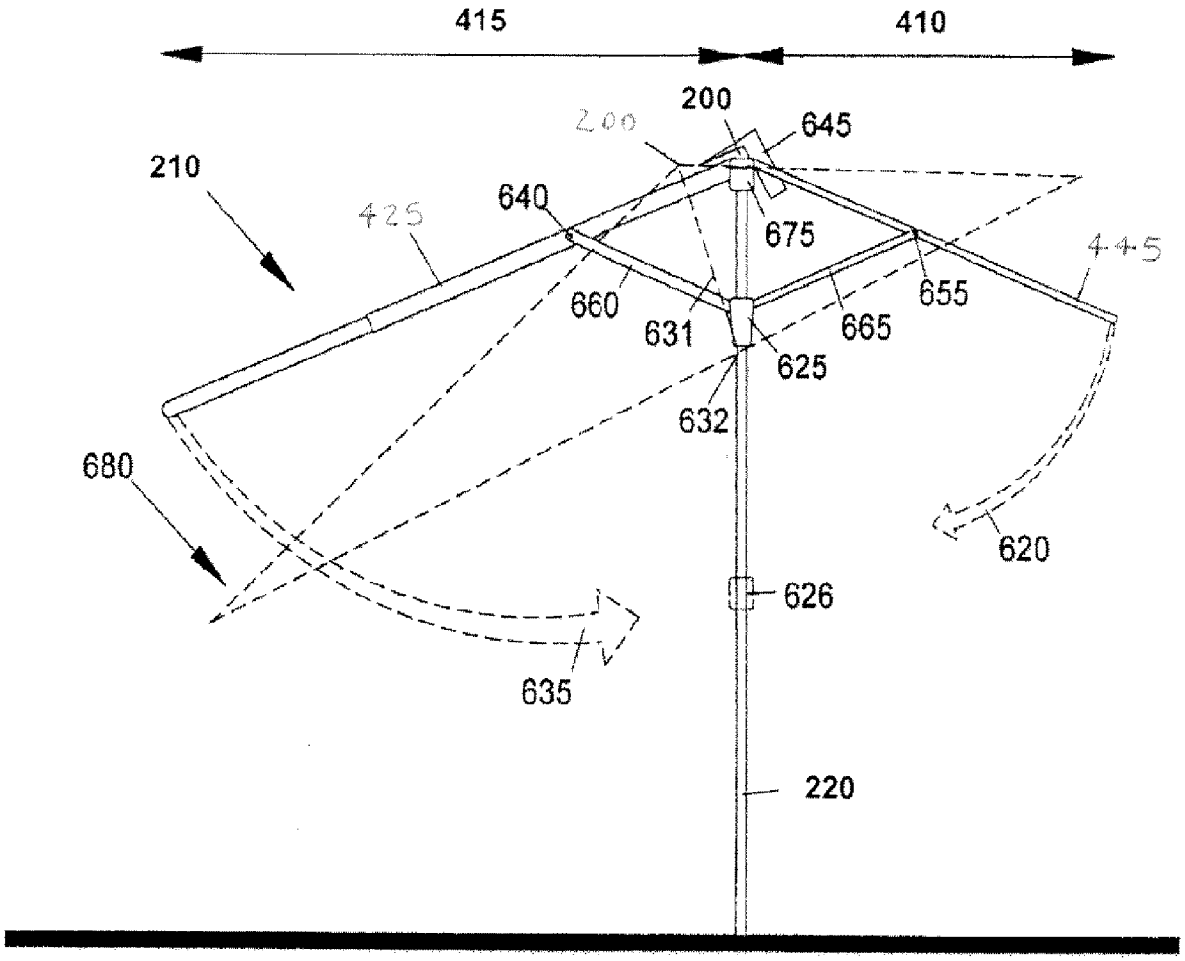
FIG. 6 shows a sectional side view of the covering device of the present invention supported by a fixed vertical axis element.

FIG. 6 illustrates a sectional side view with the cover removed to show the skeletal structure of the stationary covering device 210, both in the horizontal 210 and the tilted 680 positions. To one side of the fixed vertical support mechanism 220 lies the exemplary octagonal extension 410 of the canopy and to the other lies the visor extension 415. A plurality of support members on the exemplary octagonal extension 410 is represented using only one support rib 445 for clarity. Similarly, the plurality of support members on the visor extension 415 is represented using only the main visor rib 425 for clarity. An exemplary representation of the full array of support ribs 420, 425, 430, 435, 440, 445, 450, and 455 can be seen in a plan view on FIG. 4.

The support member can have fixed or variable length. The support member can be a collapsible member, a retractable member, an extendible member or otherwise telescopic member. For example, the support member can comprise support ribs that traverse the cover creating a vaulted spacing. In this specification, reference to telescopic includes but is not limited to, support members that can be extended or retracted.

The covering device 210 can be opened or closed via a sliding collar 625 which travels vertically over a pole 220 and is attached to struts 660 and 665 that are in turn connected to the support ribs 445 and 425 of the canopy. A fixed collar 675 beneath the apex point 200 of the canopy 210 accommodates and secures the ends of supporting ribs 445 and 425 that terminate beneath the canopy apex point 200, to the pole 220. The sliding collar 625 and the fixed collar 675 are fabricated to accommodate ribs of varying sizes. The pole 220 may be made of aluminum or some other metal, alloy, or compound, preferably aluminum, with a final finishing that will cause the collar 625 to slide with the least possible resistance or friction and one that will resist damage from corrosive elements. The pole 220 may have any of a wide range of diameters, for example, from 1.5" to 2.5", and is dependent on the size of the canopy and cover selected.

Struts 660 and 665 are hinged or pinned 640 and 655 both to the support ribs 445 and 425, and to the sliding collar 625. The support rib 425 is the primary telescopic support rib, one of the three telescopic support ribs within the visor extension 415 of the canopy. This exemplary arrangement can also be seen in the plan view of FIG. 4, represented by support ribs 420, 425, and 430.

The canopy can be rotated around pole 220. The arcs 620 and 635 depict the arcs of travel that the free ends of support ribs 445 and 425 will traverse as the device is closed (the opening arcs would be in the opposite direction). In the fully closed position, the visor extension 415 support ribs will retract to a length equal to that of the exemplary octagonal portion support ribs. This is accomplished by the telescopic action of the three exemplary support members on the visor extension 415 of the canopy. In this manner, the device closes similarly to a standard, symmetrical umbrella, and has virtually the same visual appearance when in the closed position.

In a preferred embodiment of the invention, the struts 660 and 665 are aluminum. The struts 660 are attached to the telescopic supporting ribs 425. Preferably, the struts 660 are gauged and are sized to support the maximum weight of the canopy size selected, including the weight of the canopy extensions and the accompanying components. In one exemplary embodiment, the retractions of the telescopic support ribs 425 are activated by and coordinated with, the action closing or otherwise collapsing the canopy of the stationary covering device.

The relationship of the vertical travel distance of the sliding collar 625 to the extension distance of the primary telescopic support rib 425 can be suitably selected by proper dimensioning of the functioning elements that provide for opening and closing or otherwise collapsing the canopy. In a variable length arrangement, the telescopic support ribs 425 each have an extendible portion and a fixed portion. The fixed and extendible portions are slidingly connected using a track and wheel arrangement so that the extension rib can extend from the support rib. An extension rib stop will prevent the extension rib from sliding out of the support rib when extended, and in addition to the inherently limiting nature of the flexible connection between the extendible portion of support rib 425 and the sliding collar 625. The fixed portion of the supporting rib 425 is connected to the fixed collar 675. The extendible portion of support rib 425 is connected to sliding collar 625 via an arrangement of small diameter cable or rope and a pulley system from a fixed connection point at the canopy apex 200 end of the extendible portion, through a point on or near the canopy apex point 200 and fixed collar 675, and down pole 220, either surface mounted on or within pole 220, to a fixed connection on sliding collar 625 to ensure that rib retraction is coordinated with the device closing and opening action. The canopy 210 can be opened by the raising the sliding collar 625 either manually, via a typical rope and pulley system, or by a spring assisted opening mechanism, thereby allowing the telescopic extendible portion of support rib 425 to extend, either by gravity as it travels through its opening arc, or with the assistance of spring loaded tension devices located on or within the fixed portion of telescopic support rib 425. The sliding collar 625 vertical travel distance along pole 220 is approximately represented by the distance between the closed position location 626 of the sliding collar 625, and the open position of the sliding collar at location 625.

The cover of the canopy is fabricated to accommodate both its opening and the closing, such that all ribs, struts, and components, in the open position, cause the canopy 210 to be appropriately taut and demonstrative of the canopy 210 design geometry, while at the same time, allowing canopy 210 to close completely and efficiently. An opening at the apex 200 of the canopy 210 at the top of pole 220 can be covered by a separate canopy segment, not shown, to allow both for the closing and venting of canopy 210. Such a separate; canopy covering segment is fabricated of the same cover material, and reflective of the same segmental canopy geometry, proportionate to its smaller size, as previously described. The canopy 210 vents heat and/or wind loads via this separate covering at the top of pole 220, either alone, or in conjunction with other slits, openings, or louvered sections in the canopy cover 210, located in the exemplary octagonal portion 410 of the cover, the visor extension 415 of the cover, or any combination thereof.

In an embodiment of the invention there are telescopic support ribs 425 on the visor extension 415. The telescopic support ribs 425 accommodate the visor extension 415 and allow the support ribs 425 to extend beyond the symmetry of a typical, symmetrical octagon. This arrangement can also be seen in the plan view of FIG. 4 where an exemplary arrangement of three telescopic support ribs 420, 425, and 430 comprise the visor extension 415 and facilitate forming the exemplary curved leading edge 405 of the visor extension 415.

As shown in FIG. 4, the main telescopic support rib 425 is located between the adjacent telescopic support ribs 420 and 430 on the visor extension 415. The main telescopic support rib 425 creates an apex for the curved canopy edge and is intended to be pointed directly at the sun to prevent the sun's rays from reaching the targeted coverage zone in a fixed area beneath the canopy 210 where shading targets are protected from the sun. In an embodiment of the invention, the telescopic support ribs 420, 425, and 430 in FIG. 4 are made of aluminum or some other metal, alloy, or compound which is preferably resistant to rust and/or corrosion. In one exemplary embodiment, the thickness of the walls of the aluminum ribs 445 and 425 range from approximately 0.06 to 0.13 inches. The maximum cantilevered and extended distance of the extendible portion of the primary telescopic support rib 425 (shown as 425 in FIG. 4) in this embodiment is approximately 2' 8".

The exemplary octagonal extension 410 also has support ribs 445 extending from the fixed collar 675 at the top of the pole 220 and attached to the sliding collar 625 via a strut 665. In this embodiment there are five support ribs 445, which can be seen clearly in FIG. 4, labeled as 435, 440, 445,450 and 455. The support ribs 445 on the exemplary octagonal extension 410 are of fixed length. They are preferably made of aluminum or some other durable, rust resistant metal, alloy, or compound.

The cover is supported by the support members described above. As previously stated, the cover can also be made of various suitable, preferably lightweight, material, including pliable material supple enough to bend freely or repeatedly without breaking, such as cloth, plastic, nylon, etc. For example, cloth can be fabricated by weaving, felting, or knitting, natural or synthetic fibers and filaments. Such natural or synthetic fibers and filaments can be made of lightweight ultraviolet resistant material or material that yields adjustably to varying weather conditions and/or conditions of device use. The cover can be a single integrated unit or it can be made up sub-units, e.g., cloth, molded pieces, etc., that are pieced together to provide the protection function of the cover.

In a preferred embodiment, the cover includes sleeves that surround and cover the visor portion telescopic support ribs 425. The sleeves are of a length sufficient to cover at least the extended portion of the support ribs 425. The sleeves may cover the length of the support ribs 425, but may only cover a portion thereof. The sleeves are attached to the fixed portion of support rib 425. Preferably, retraction of the visor extension 415 of the cover occurs concurrently with the extension or retraction of telescopic support ribs 425, via an independent cord and set of pulleys or other similar arrangement, as support ribs 425 either extend or retract during either opening or closing. The end, edge and underside of the cover sleeves on the ribs 425 may be cushioned to protect the users from inadvertent contact with the visor extension 415 of the canopy.

An embodiment of the invention may also include an alignment gauge 645 which enables the user, while seated under the opened canopy, to align the main telescopic support rib 425 as shown in FIG. 4 toward the sun to obtain the maximum amount of shade to the shading targets beneath the canopy of the stationary covering device 210. Preferably, the alignment gauge 645 will consist of a light transmitting material such as glass or polished, clear acrylic, with limiters on the sun side to ensure only the collection of direct sunlight. The collected, direct sunlight will be channeled through the light transmitting material, and exit via a polished face of alignment gauge 645 visible from beneath the canopy cover and aimed at a logical shading target position, thereby enabling the user located at that position to easily judge the optimum orientation of the device by observing the amount of light transmitted by the alignment gauge 645. Sunlight transmitted through alignment gauge 645 will be filtered on the exit face located beneath the canopy cover.

In another embodiment, the canopy is fastened to some elevated point without support from below the canopy, and is free on all sides except at the point of support at the asymmetrically positioned canopy vertex point. As such, the fixed support mechanism comprises a cantilevered support connected to the asymmetrically positioned canopy vertex point from above the canopy. The cantilevered support includes a projecting beam or member that is supported at only one end, for example with a bracket-shaped member that supports the canopy. In this way, the canopy is free on all sides except at a point of support from the above at the asymmetrically positioned vertex point.

FIG. 6 also illustrates, with dotted lines, the canopy in the tilted position 680. When in the open and tilted position, the fixed vertical support 220 has a tilted section 631 originating from a hinge point 632 located on the axis of fixed vertical support 221) comprising any suitable jointed or flexible device that facilitates an inclination of the canopy 210 by the user, within a limited and pre-determined tilting arc, approximately represented by the difference between canopy positions 210 and 680. The hinge point 632 is located below the position of sliding collar 625 when the canopy is in the open position 210, or may be located nearer to fixed collar 675, depending upon the mechanical advantage required to support the selected canopy 210 size, and the structural properties associated with the specific materials of manufacture. The tilted canopy 680 has a tilted longitudinal axis along its length that creates a sloping direction relative the ground, as defined by the exemplary position of the hinge point 632 on the fixed vertical support 220, and the amount of canopy inclination to be provided. The location of the hinge 632 is a point on the fixed vertical support 220 from which the canopy tilted position 680 can be further adjusted, and thereby extend the range of the adjustable coverage to the targeted stationary area throughout the day. The canopy 210 is rotatable about vertical pole 220, whether the canopy apex point 200 is vertically aligned with pole 220, or the canopy is in the tilted position 680, with the tilted canopy apex point 200 either inclined away from the vertical axis of pole 220, or more approximately in alignment with vertical pole 220 if the hinge point 632 is located nearer to fixed collar 675.

Figure 7:
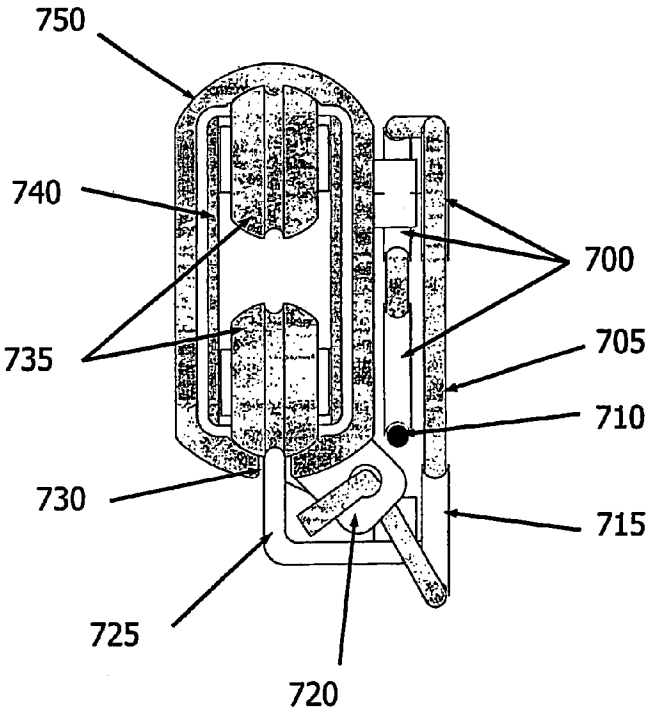
FIG. 7 shows a sectional detail view of an extendible and retractable support rib.

FIG. 7 shows a sectional view of a support rib, such as support rib 425 in FIG. 6. As shown in FIG. 7, an exemplary embodiment of the invention includes a retractable support rib at the three extended visor portion support rib locations, more clearly illustrated in the plan view of FIG. 4, and labeled 420, 425, and 430. The withdrawing and extending action of the retractable rib will be actuated by either opening or closing the device, whether manually, with the mechanical advantage of a cable and pulley system, or with the advantage of a spring assisted opening mechanism, or any combination of these systems.

The supporting member 750 is pinned or hinged to the fixed upper collar 675 in FIG. 6 beneath the apex point of the canopy 200 in FIG. 6. Supporting member 750 may be any one of a number of cross sectional shapes, including rectangular, oval, or other common geometric shape, and configured in such a way so that any accessory devices, such as pulleys, brackets, rollers, or other canopy operating and/or canopy fabric retraction hardware components may be conveniently attached to support rib 750, and thereby facilitate the extension and retraction of an extendible portion 740 of the support rib 750 as well as retract the excess visor portion fabric/covering. The length of the fixed portion of support rib 750 is approximately equal to that of support ribs 435, 440, 445, 450, and 455, shown in FIG. 4.

In an embodiment of the invention, the support rib 750 and the extendible and retractable portion 740 may be made of aluminum, or some other metal, alloy, or compound which is preferably resistant to rust and/or corrosion.

A further embodiment of the invention includes a mechanical connection to at least two fixed points, one of which is located at the end of the extendible rib portion 740 nearest the apex point 200 of the canopy 210 in FIG. 6, through a location beneath the apex point 200 of the canopy cover 210 in FIG. 6, on or near fixed collar 675 in FIG. 6, to a fixed point located on, or within the moveable collar 625 illustrated in FIG. 6. Such a mechanical connection will cause the action of either opening or closing the device to either withdraw or allow extension of the extendible portion 740 of support rib 750, by connecting those elements to moveable collar 625 in FIG. 6. Any vertical distance that moveable collar 625 travels, therefore, will be transmitted, either in kind or proportionally as desired, to the extendible portion 740 of the support rib 750. The mechanical connection material may consist of any number of suitable materials, including small diameter steel aircraft cable, pliable woven wire, or various rope materials, or any combination thereof, that are durable and resistant to corrosion.

The extendible portion 740 is configured to support its maximum extended, cantilevered distance when in the extended position, and be of an additional length as necessary to maintain adequate engagement with the fixed portion of the support rib 425, the supporting element for the cantilever. A system of wheels or rollers 735, engaged to a track on or within support rib 750 will facilitate the controlled and predictable movement of the extendible portion 740. In an embodiment of the invention, any wheels, rollers, or bearings facilitating the extension and retraction of the extendible portion 740 of the rib would be made of nylon, delrin, or some other appropriately durable, non-maintenance intensive, low friction, and lightweight material. In an embodiment of the invention, any pulleys facilitating the extension and retraction of either the extendible portion 740 of the rib or the visor fabric would be of precision manufacture, include sleeves and/or bearings to minimize friction and thereby support ease of operation, and be made of nylon, stainless steel, coated steel, or some other appropriately durable, and non-maintenance intensive material.

in one embodiment, the lower face of support rib 750 is slotted 730. The slotted opening would allow a traveler bracket 725 to be attached to extendible portion 740 of support rib 750 at the end nearest the canopy vertex point 200 in FIG. 6. The slot or opening 730 would be of a length sufficient for the bracket 725 to travel with the extendible portion 740 of support rib 750 toward the apex of the canopy 200 on FIG. 6, a slotted distance equal to at least that of the extendible rib 740 cantilevered distance when in the extended position.

In a further embodiment, a small diameter cable, woven wire, or rope 705 passes around a pulley affixed to the traveler bracket 725. One end of this connection 710 is affixed to the canopy covering at the leading edge of the visor portion 405 in FIG. 5 the device through a grommet, and/or other attachment accommodation device capable of resisting tearing and able to accommodate a secure, fixed connection in the canopy covering material. The other end of this connection, via a system of four pulleys 700 and 715, would be attached to the fixed bracket 720 at the visor end 405 in FIG. 5 of the fixed portion 750 of the support rib.

In the case of closing the device, for example, extendible rib 740 retracts, causing the affixed traveling bracket 725 and attached pulley 715 to move away from the leading edge of the visor canopy 405 toward the apex of the canopy 200, both illustrated in FIG. 5. Three fixed location pulleys 700 mounted on, within, or near the supporting rib 750, at locations proportional to the geometry of the device, proportional to the vertical travel distance of the moveable collar 625 in FIG. 6, and proportional to be cantilevered distance of the extendible rib portion 740 as measured in the open position, will both cause and facilitate retraction of the excess canopy covering material beneath support rib 750 as the device closes. The action of retracting the excess covering material (the amount of covering material on any segment of the exemplary visor extension 415 of FIG. 5 that exceeds the amount of covering material on any segment of the exemplary octagonal portion 410 on FIG. 5) and the extending and retracting of the support ribs 420, 425, and 430 on FIG. 6 enable the device to open and close efficiently, without interfering with any objects, such as furniture, that would normally found beneath a device of this type. Support ribs 420 through 455, inclusive, 4, are therefore all of approximately equal length when in the closed position.

Figure 8:
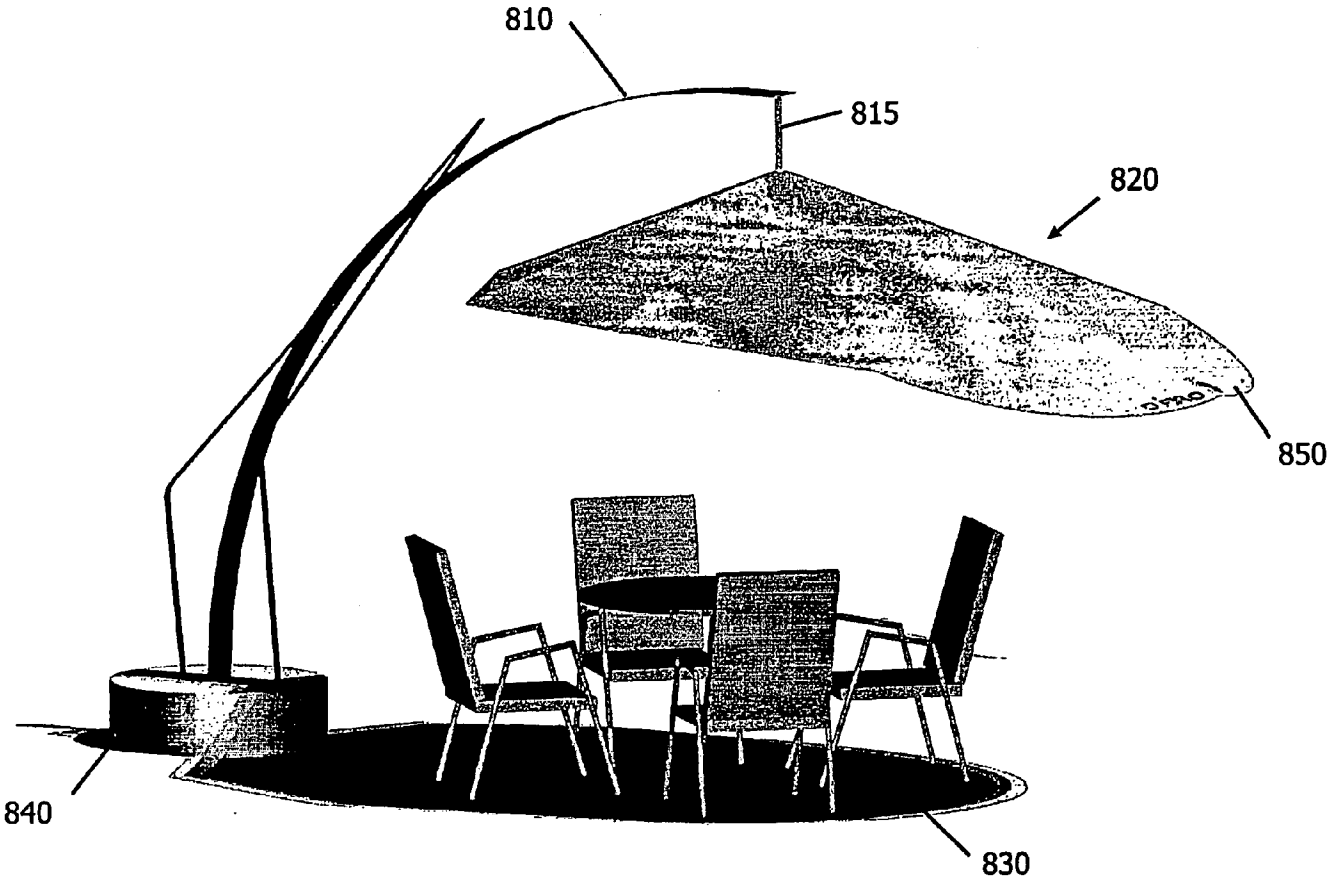
FIG. 8 shows a perspective view of another embodiment of the stationary covering device having a cantilevered support.

FIG. 8 shows an embodiment the covering device of the present invention, where a fixed support mechanism comprising a cantilevered supporting arm 810 is used for suspending the canopy 820 using a hanger-like vertical extension or tension member 815. The supporting arm 810 is Listened to the asymmetrical apex point 800 of the canopy 820 via tension member 815. In this way, the canopy can revolve around the fixed longitudinal axis. The cantilevered supporting arm 810 supporting the connecting vertical tension member 815 rests on a surface 840 to the side of the canopy 820. The cantilevered supporting arm 810 would then provide support to suspend the canopy 820 from above. As with the other embodiments of the invention, as shown in FIGS. 2 and 3, the canopy 820 provides a coverage zone 830 that protects a fixed target zone directly beneath it, and does so most effectively when the curved leading edge of the canopy 850 is pointed directly toward the sun. The cantilevered supporting arm 810 is configured in a way such that the canopy 820 is rotatable 360 degrees when suspended from the connecting tension member 815.

Canopy 820 will open and close in a manner similar to that described and illustrated in FIG. 6, but without the need for vertical supporting pole 220 in FIG. 6. In the embodiment of the invention illustrated in FIG. 6, the hinge point 632 for the tilting function is located at or below the canopy apex point 800 of canopy 820 illustrated in FIG. 8. A fixed collar (not shown in FIG. 8) but similar to fixed collar 675 in FIG. 6, and a moveable collar (not shown in FIG. 8) similar to sliding collar 625 in FIG. 6 accommodate, facilitate, and control the opening, closing, and tilting canopy functions.

Both embodiments of the invention as described herein, provide a canopy that protects a pre-determined coverage zone and/or set of fixed shading targets. In each case, rotation and/or tilting of the canopy facilitates the protection. In this embodiment, the location of supporting arm 810 and surface position 840 need not be predetermined in order for the canopy to function optimally, as in the case of prior art, symmetrical canopies. Rather, the canopy itself need only be positioned above the target in order to obtain optimal performance.

While certain exemplary embodiments have been described in this specification and shown in the accompanying drawings, it is to be understood that such embodiments are merely illustrative of and not restrictive on the broader invention, and that this invention is not to be limited only to the specific constructions and arrangements shown and described, because various other changes, combinations, omissions, modifications, and substitutions, in addition to those set forth above and below, are possible. Those skilled in the art will appreciate that various adaptations and modifications of the preferred embodiment can be configured without departing from the scope and spirit of the invention. Therefore, it is to be understood that, within the scope of the appended claims, the invention may be practiced other than as specifically described herein.

I claim:

1. A canopy for a stationary covering device, comprising:

a cover having an asymmetrically positioned vertex point from which the cover projects with unequal extensions, the cover having a leading edge, wherein at the asymmetrically positioned vertex point, the canopy is tiltable around a fixed longitudinal axis relative to the ground to provide an adjustable coverage zone within a desired stationary area when tilted from a first canopy position to a second canopy position at an elevational level relative to the ground;

wherein at least one of the unequal extensions comprises a visor extension that is supported by a main support member and a plurality of adjacent support members, the plurality of adjacent support member having a length less than a length of the main support member;

wherein the main support member creates an apex for the leading edge, wherein the apex is configured to allow the cover to be aligned with respect to the sun to provide the adjustable coverage zone; and wherein the unequal extensions define a ratio of asymmetry between the length of the visor extension with respect to the length of adjacent support members, in a range between 1.5:1 and 2.3:1.

2. The canopy of claim further comprising one or more traversal support members that support the unequal extensions from the vertex point.

3. The canopy of claim 2, wherein the one or more traversal support members comprise one or more support ribs that traverse the cover.

4. The canopy of claim 3, wherein at least one of the one or more support ribs has a variable length.

5. The canopy of claim 2, wherein the one or more traversal support members comprise at least one of a collapsible member, a retractable member and an extendible member.

6. The canopy of claim 1, wherein the cover comprises a pliable material, and wherein the pliable material comprises at least one of a lightweight ultraviolet resistant material, a cloth material, a nylon material, or an acrylic material.

7. The canopy of claim 6, wherein the cover is fabricated as at least one of a single integrated unit and a number of pieced together sub-units.

8. The canopy of claim 1, wherein the longitudinal axis is a tilted longitudinal axis.

9. The canopy of claim 8, wherein a fixed support mechanism comprises a vertical support at the asymmetrically positioned vertex point from beneath the canopy.

10. The canopy of claim 8, wherein a fixed support mechanism comprises a cantilevered support at the asymmetrically positioned vertex point by a projection from above the canopy.

11. The canopy of claim 8, wherein said coverage zone comprises a shading zone for providing shade during daylight hours.

12. The canopy of claim 8 further comprising one or more traversal support members that support the unequal extensions from the vertex point.

13. The canopy of claim 12, wherein the one or more traversal support members comprise one or more support ribs that traverse the cover.

14. The canopy of claim 12, wherein at least one of the one or more traversal support members has a variable length.

15. The canopy of claim 12, wherein the one or more traversal support members comprise at least one of a collapsible member, a retractable member and an extendible member.

16. The canopy of claim 8, wherein the cover comprises a pliable material and wherein the pliable material comprises at least one of a lightweight ultraviolet resistant material, a cloth material, a nylon material, or an acrylic material.

17. The canopy of claim 8, wherein the cover is fabricated as at least one of a single integrated unit and a number of pieced together sub-units.

18. The canopy of claim 1, wherein the fixed longitudinal axis is at least one of a longitudinal axis or a tilted longitudinal axis.

19. The canopy of claim 1, wherein the main support member and adjacent support members are extendable and wherein the visor extension is extendable and retractable.

20. A covering device, comprising:

a canopy, comprising a cover having an asymmetrically positioned vertex point from which unequal extensions extend, wherein at the asymmetrically positioned vertex point, the canopy is tiltable around a fixed longitudinal axis relative to the ground to provide an adjustable coverage zone within a desired stationary area when tilted from a first canopy position to a second canopy position at an elevational level relative to the ground; and a fixed support mechanism for positioning the canopy relative to the elevated level; and wherein the unequal extensions define a ratio of asymmetry between a length of a visor extension with respect to a length of adjacent support members, as measured from the in a range between 1.5:1 and 2.3.1.

* * * * *

UNITED STATES PATENT AND TRADEMARK OFFICE

CERTIFICATE OF CORRECTION

PATENT NO. : 7,814,920 B2
APPLICATION NO. : 10/588249
DATED : October 19, 2010
INVENTOR(S) : David G. Lenahan It is certified that error appears in the above-identified patent and that said Letters Patent is hereby corrected as shown below:

Column 1, line 16, “nixed” should be changed to -- i.e., fixed --

Column 2, line 18, “be” should be changed to -- the --

Column 3, line 32, “paint” should be changed to -- point --

Column 3, line 58, “kited,” should be changed to -- felted, --

Column 4, line 9, please insert the word -- in -- after the cover...

Column 6, line 4, “thr” should be changed to -- for a --

Column 8, line 4, “equipped” should be changed to -- required --

Column 9, line 47, “treasured” should be changed to -- measured --

Column 15, line 5, “Listened” should be changed to -- fastened --

Signed and Sealed this
Fifteenth Day of March, 2011

David J. Kappos

David J. Kappos
*Director of the United States Patent and Trademark Office*